United States Patent [19]

McLaren

[11] Patent Number: 4,629,081

[45] Date of Patent: Dec. 16, 1986

[54] CHILD RESISTANT CLOSURE AND CLOSURE AND CONTAINER ASSEMBLY

[75] Inventor: Kevin W. McLaren, Erith, England

[73] Assignee: Johnsen & Jorgensen (Plastics) Limited, England

[21] Appl. No.: 794,515

[22] Filed: Nov. 4, 1985

[30] Foreign Application Priority Data

Nov. 5, 1984 [GB] United Kingdom ..... 8427925

[51] Int. Cl.[4] ..... B65D 55/02; A61H 1/00

[52] U.S. Cl. ..... 215/206; 215/211; 215/224; 215/235; 215/237; 222/153

[58] Field of Search ..... 215/206, 211, 216, 224, 215/225, 237, 235, 245; 222/153

[56] References Cited

U.S. PATENT DOCUMENTS 4,022,352 5/1977 Pehr ..... 215/224

4,513,888 4/1985 Curry ..... 222/153

*Primary Examiner*—George T. Hall

*Attorney, Agent, or Firm*—Wood, Dalton, Phillips, Mason & Rowe

[57] ABSTRACT

This invention comprises a two part closure, for a container, comprising a top cap hingedly connected to an inner cap which is adapted to be semi-permanently positioned over the mouth of an associated container, a depending skirt on the inner cap and a trigger forming part of the skirt of the inner cap, actuation of the trigger normally being prevented by engagement of the trigger with an arcuate bead on the outside of the associated container whereby the trigger forms a locking means to hold the top cap in its closed position until the closure is angularly displaced relatively to the container into a predetermined position in which the trigger is unlocked and can be actuated manually to release the top cap for opening.

10 Claims, 3 Drawing Figures

CHILD RESISTANT CLOSURE AND CLOSURE AND CONTAINER ASSEMBLY

This invention is conerned with the provision of a child-resistant container and closure assembly, particularly though not exclusively for use in holding harmful powders and liquids. The invention also provides an improved child-resistant closure for use in combination with a suitably shaped container.

It is well known that accidents may be caused if young children remove the closure from a container the contents of which are harmful e.g. cleaning fluid. It is an object of this invention to minimise the risk of such accidents happening.

According to the present invention there is provided a two part closure comprising a top cap hingedly connected to an inner cap which is adapted to be semi-permanently positioned over the mouth of an associated container, the inner cap being provided with locking means to hold the top cap in its closed position until the closure is angularly displaced relatively to the container into a predetermined position in which a trigger on the inner cap can be depressed to release the locking means.

The invention also includes a closure and container assembly constructed and adapted to operate as described above when the closure is in position on the container.

Preferably the trigger forms part of a depending skirt provided on the inner cap, actuation of the trigger normally being prevented by engagement of the trigger with an arcuate bead on the outside of the neck of an associated container. In fact the arcuate bead may, in fact, be an annular bead with just one gap in the bead of sufficient width to allow the trigger to be pressed inwards when the trigger is aligned with the gap. The trigger has a catch which normally engages with a locking bead on the top cap so that the top cap is held in position until the locking bead is released by inward movement of the catch when the trigger is depressed.

In order that the invention may be more clearly understood reference is now directed to the accompanying drawings, given by way of example in which:-

Figure 1:
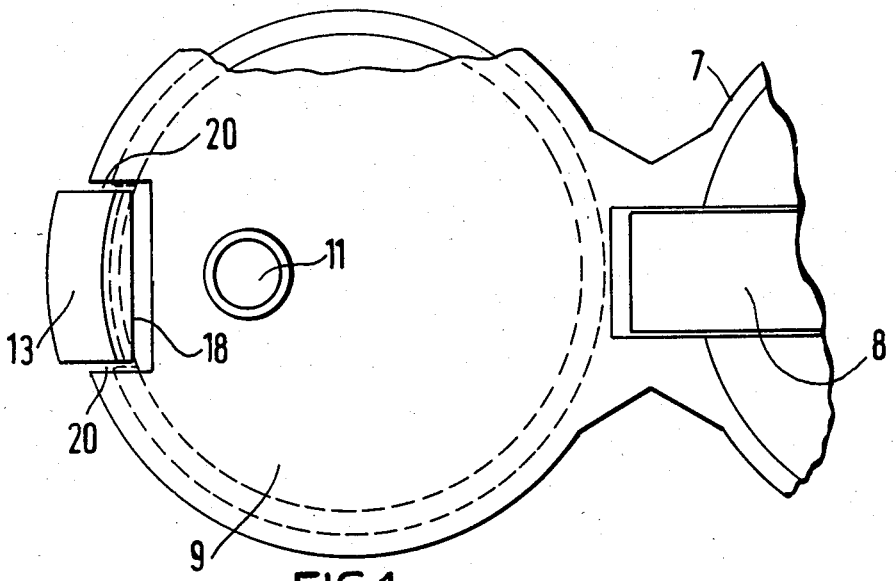
Figure 2:
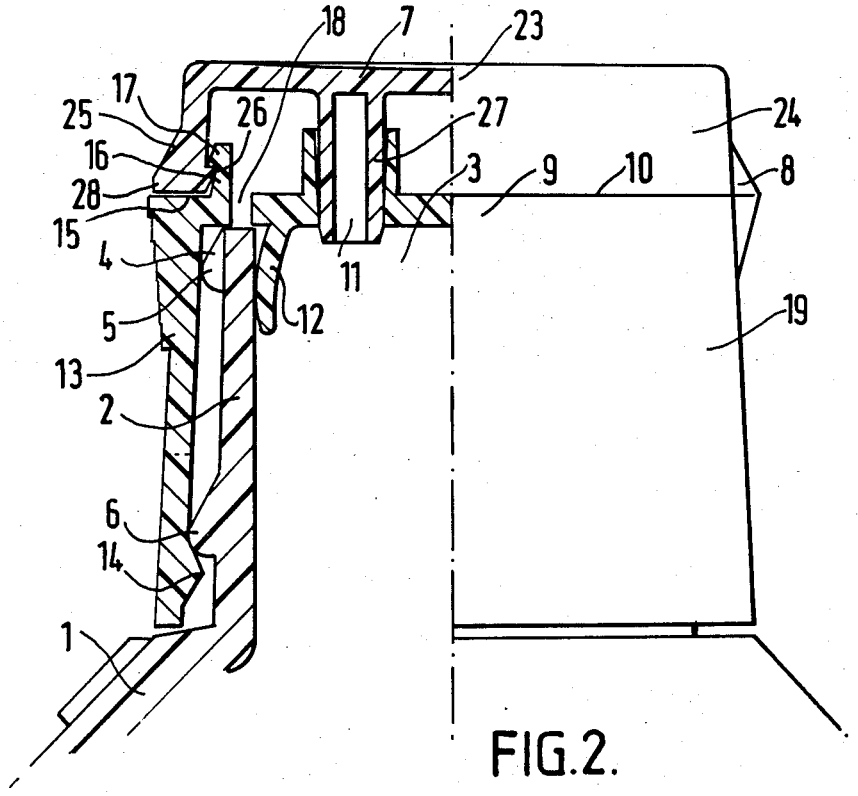
Figure 3:
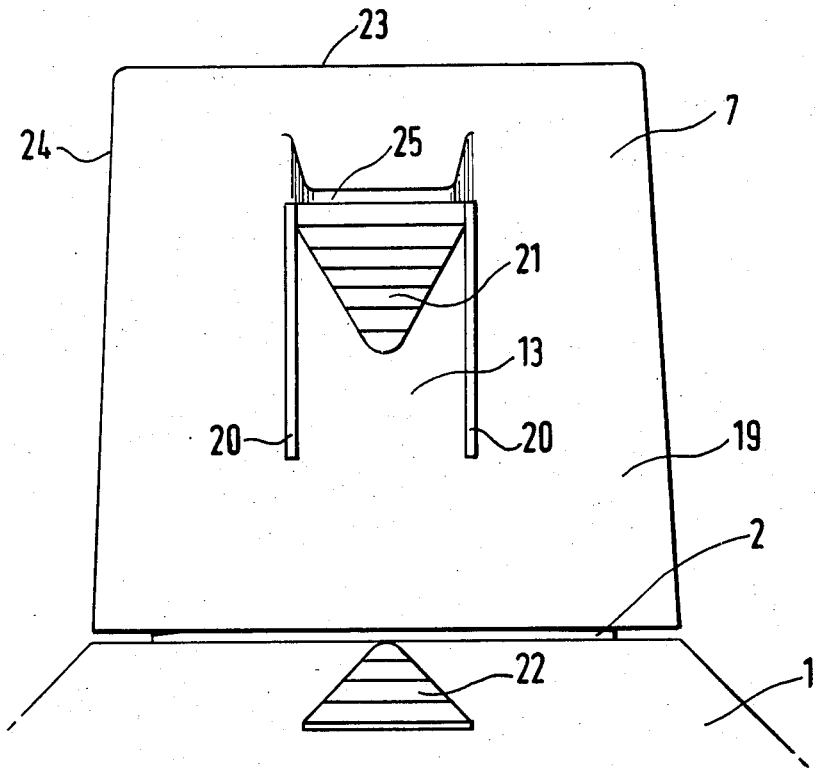

FIG. 1 is a plan view of a closure embodying the invention with the top cap open, FIG. 2 is a part-sectional side elevation taken on the centre line showing the release trigger ready to be depressed, and FIG. 3 is a front elevation showing arrows lined up allowing trigger to be pressed into a gap in the top bead on the container.

Referring to the drawings in more detail a container 1 has a neck 2 with an open mouth 3. The neck 2 has an arcuate external top bead 4 with a gap 5 provided therein and the neck 2 also has an annular lower external retaining bead 6.

The container 1 may be made of any suitable material e.g. glass or plastics material.

A two part closure is provided comprising a top cap 7 connected by a suitable form of a hinge 8 to an inner cap 9. The inner cap 9 has a top 10 with a circular opening 11 and a depending annular plug 12 which seats within the mouth 3 of the container 1. The inner cap also has a trigger 13 which extends downwardly of the neck 2 of the container to engage with the retaining bead 6, an internal bead 14 being provided on the trigger 13 to engage below the bead 6. At the upper end the trigger has a ledge 15 and a vertical pillar 16 with an outwardly projecting hook member or retaining catch 17. A gap or slot 18 is provided between inner edge of the pillar 16 and the top 10 of the inner cap 9. As shown in FIGS. 2 and 3 the inner cap has a depending skirt 19 which embraces the neck 2 of the container 1, the trigger 13 being separated by slots 20 from the main part of the skirt, to allow the upper part of the trigger to be pressed into the gap 18. The trigger 13 is provided with an arrow shaped or other suitable indicator 21 to be lined up with an arrow shaped or other suitable indicator 22 on the container 1 when it is desired to open the top cap 7. Thus, as seen in the drawing, the bead 4 and trigger 13 define cooperating stop means preventing manipulation of the trigger other than when the inner cap is angularly rotated to said alignment.

The top cap 7 has a top 23 and a short depending skirt 24 provided with an enlarged portion 25 which meets the ledge 15 when the top cap is closed—see the left hand side of FIG. 2. The enlarged portion 25 has an internal locking bead 26 for co-operation with the retaining catch 17 to hold the top cap 23 in its closed position a shown at the left hand side of FIG. 2. The top cap 7 also has a plug member 27 depending from the underside of the top 23 of the top cap 7 and shaped to fit within the opening 11 when the top cap is closed.

Any suitable form of hinge may be provided, for example a simple hinge similar to the hinge provided in our JAYCAP (Registered Trade Mark) closure may be used but we prefer to provide a snap hinge 8. By a snap hinge cover we mean a cover with a snap hinge arranged to keep a cap part of the cover either in an open or in a closed position as in our JAYSNAP cover. Full details of the snap hinge have not been given in this specification because the construction is well known e.g. from British Pat. Nos. 1212248, 1230215 and 1251353 to which reference is directed for further information, but we emphasize that the use of a snap hinge in this invention is not essential. Any suitable form of hinge may be used.

In operation, assuming that the parts are in the position shown in FIG. 2 i.e. the closure is in the closed position, a user will line up the arrow 21 on the inner cap 9 with the arrow 22 on the container 1. The user then presses the arrow 21 which moves the trigger 13 to the right in FIG. 2 thus releasing the retaining catch 17 from the locking bead 26. When the parts are in the position shown in FIG. 2 top cap cannot be raised but depression of the trigger releases the top cap from restraint and upward pressure on thumb tab 28, formed by the enlarged portion 25, which has been made accessible by pressure on the trigger will enable the top cap to be to be moved to the position shown in FIG. 1. Hinging movement of the top cap removes the plug 27 from the opening 11 which is now open so that the contents of the container are accessible.

To re-close the top cap the hinging movement is repeated in the opposite direction, the locking bead 26 snaps past catch 17 and the top cap is locked in position. To prevent unauthorized re-opening the closure is then angularly displaced to bring the arrows out of alignment. With the arrows out of alignment the trigger cannot be depressed because the trigger 13 is not aligned with the gap 5 in the bead 4. Naturally the gap 5 is of sufficient width to ensure that the trigger can be depressed when the arrows are aligned.

It will be understood that the inner cap is permanently secured in position on the container by engagement of the internal bead 14 below the external retaining bead 6 and in the preferred arrangement the inner cap can be removed only by mutilation of the closure.

I claim:

1. A child resistant two part closure, for a container, comprising a top cap hingedly connected to an inner cap which is adapted to be semi-permanently positioned over the mouth of an associated container, the top cap and inner cap being provided with cooperating locking means for holding the top cap in a closed position, the container and inner cap being provided with cooperating relatively rotatable stop means for preventing release of said said locking means until the closure is rotatively displaced relatively to the container in a first operation into a predetermined position in which the stop means on the inner cap can be manipulated free of the stop means on the container in a second operation to release the locking means.

2. A two part closure, for a container, comprising a top cap hingedly connected to an inner cap which is adapted to be semi-permanently positioned over the mouth of an associated container, a depending skirt on the inner cap and a trigger forming part of the skirt of the inner cap, actuation of the trigger normally being prevented by engagement of the trigger with an arcuate bead on the outside of the associated container whereby the trigger forms a locking means to hold the top cap in its closed position until the closure is angularly displaced relatively to the container into a predetermined position in which the trigger on the inner cap can be depressed to disengage the trigger from locking engagement with the top cap.

3. A closure according to claim 2 for cooperation with a container wherein the arcuate bead on the container is a substantially annular bead with just one gap in the bead of sufficient width to allow the trigger to be pressed inwards when the trigger is aligned with the gap.

4. A closure according to claim 1 or 2 wherein the inner cap has a top with an opening therein and a depending annular plug to seat with the mouth of an associated container.

5. A closure according to claim 2 wherein the trigger extends downwardly of the neck of the container to engage with the retaining bead and wherein the internal bead is provided on the trigger to engage below the bead on the container, the trigger having a ledge and a substantially vertical pillar at the upper end with a retaining catch to engage with an internal locking bead on the top cap.

6. A closure according to claim 5 wherein a gap is provided between the inner edge of the pillar and the top of the inner cap and wherein the trigger is separated by slots from the main part of the skirt of the inner cap to allow the upper part of the trigger to be pressed into the gap, the trigger being provided with an indicator to be lined up with an indicator on the container when it is desired to open the top cap.

7. A closure according to claim 2 wherein the top cap has a top and a short depending skirt provided with an enlarged portion which meets a ledge on the upper part of the trigger when the top cap is closed and wherein the enlarged portion of the short depending skirt has an internal locking bead for cooperation with a retaining catch on the trigger to hold the top cap in its closed position.

8. A closure according to claim 7 wherein the top cap also has a plug member depending from the underside of the top of the top cap and shaped to fit within an opening in the top of the inner cap.

9. A closure according to claim 1 or 2 wherein the hinge is a snap hinge.

10. A container and closure assembly comprising a two part closure as claimed in claim 1 or 2 and a container with an arcuate bead on its outer surface for engagement by the trigger of the closure.

* * * * *